US006779819B2

(12) United States Patent
Surko, Jr.

(10) Patent No.: US 6,779,819 B2
(45) **Date of Patent: *Aug. 24, 2004**

(54) EXIT DEVICE HAVING PRESS BAR-OPERATED ELONGATED SECURING MEMBER

(75) Inventor: Walter E. Surko, Jr., Southington, CT (US)

(73) Assignee: Yale Security Inc., Monroe, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/080,587

(22) Filed: May 18, 1998

(65) Prior Publication Data

US 2002/0105191 A1 Aug. 8, 2002

Related U.S. Application Data

(63) Continuation-in-part of application No. 08/476,345, filed on Jun. 7, 1995, now abandoned, which is a continuation-in-part of application No. 08/144,243, filed on Nov. 1, 1993, now abandoned.

(51) Int. Cl.[7] ..... E05B 65/10

(52) U.S. Cl. ..... 292/92; 292/172

(58) Field of Search ..... 292/92, 5, 7, 21, 292/93, 94, DIG. 24, DIG. 65, 192, 166, 172, 160, 170, 142; 70/92

(56) References Cited

U.S. PATENT DOCUMENTS

| | | | | | |
|---|---|---|---|---|---|
| 203,787 | A | * | 5/1878 | Smith | |
| 220,318 | A | * | 10/1879 | Underhill | |
| 242,247 | A | * | 5/1881 | Bailey | |
| 327,833 | A | * | 10/1885 | Sparks | |
| 1,192,449 | A | * | 7/1916 | Ottinger | |
| 1,331,166 | A | | 2/1920 | Ochsner | |
| 1,924,898 | A | | 8/1933 | Anderson | 292/173 |
| 2,073,149 | A | * | 3/1937 | Geyer | 292/337 |
| 2,233,278 | A | * | 2/1941 | Aldeen | |

(List continued on next page.)

FOREIGN PATENT DOCUMENTS

| | | | | |
|---|---|---|---|---|
| DE | 4112562 A1 | | 4/1991 | E05B/15/10 |
| EP | 0651120 A2 | | 5/1995 | E05B/65/10 |
| EP | 0651120 A3 | | 10/1996 | E05B/65/10 |
| GB | 385475 | * | 12/1932 | |

*Primary Examiner*—Gary Estremsky
(74) *Attorney, Agent, or Firm*—Michael G. Johnston; Moore & Van Allen, PLLC

(57) ABSTRACT

The exit device of the present invention has an elongated securing member, such as a deadbolt or the like, adapted to be mounted horizontally adjacent the free end of a door and a pivoting member inward of the door. The pivoting member has a peripheral portion which rolls against the securing member and serves as an anti-friction bearing and counters against the inward force on the securing member opposing the opening force on the door. In one embodiment, the pivoting member is pivoted by a press bar assembly, and engages and retracts the securing member. In another embodiment, the securing member is retracted by the actuating means. The pivoting member may also include a keeper contact surface which, as the door closes, is contacted by the keeper and the pivoting member is pivoted inward to retract the securing member.

42 Claims, 9 Drawing Sheets

U.S. PATENT DOCUMENTS 2,290,727 A * 7/1942 Best ..... 292/172
2,515,560 A 7/1950 Lickteig ..... 292/166
2,644,705 A * 7/1953 Hagstrom ..... 292/169
2,656,207 A * 10/1953 Russell et al. ..... 292/169
2,764,441 A 9/1956 Marko ..... 292/173
3,432,263 A * 3/1969 Deutscher et al. ..... 292/92
3,561,805 A * 2/1971 Shaw ..... 292/172
4,080,810 A * 3/1978 Fishman ..... 70/129
4,083,590 A * 4/1978 Folger ..... 292/92
4,566,725 A * 1/1986 Klein ..... 292/191
4,576,405 A * 3/1986 Wartian ..... 292/191
4,656,849 A * 4/1987 Rotondi et al. ..... 70/134
4,796,931 A * 1/1989 Heid ..... 292/92
5,044,182 A * 9/1991 Totten ..... 70/143
5,174,617 A * 12/1992 Huber et al. ..... 292/128
5,605,362 A * 2/1997 Surko, Jr. ..... 292/92

EXIT DEVICE HAVING PRESS BAR-OPERATED ELONGATED SECURING MEMBER

CROSS-REFERENCES

This application is a continuation-in-part of U.S. application Ser. No. 08/476,345 filed Jun. 7, 1995, abandoned, which is a continuation-in-part of U.S. application Ser. No. 08/144,243, filed Nov. 1, 1993 abandoned, which is the parent of related U.S. application Ser. No. 08/527,101 which issued as U.S. Pat. No. 5,605,362, the contents of all of which I hereby incorporate by reference.

BACKGROUND

This invention relates to an exit device having an elongated securing member, and more particularly to an exit device including a press bar on the inside of a door. When the press bar is pushed, it retracts the securing member so that the door can be opened.

State and federal codes have required that exit doors for public buildings be equipped with devices so that occupants exiting a building can press a panic bar or press bar to actuate the latchbolt of the door. Such pressing—as opposed to turning a handle or knob—is natural, particularly with persons escaping a building in a panic or an emergency situation.

Devices of this sort are well known, an example being disclosed by the U.S. Pat. No. 4,796,931 to George E. Heid. The Heid patent describes the linkages between the press bar and a latchbolt which is pivotally mounted adjacent the open end of the door.

Such structures have been designed to function under extreme conditions such as, for example, a group of people rushing to exit a smoke-filled building. A large number of such persons arriving at a closed door can exert a great outward force on the door and the exit device.

A standard exit device test by Underwriters Laboratories replicating such conditions involves exerting a horizontal outward force of 250 pounds against a closed door to test the exit device installed thereon. A further test during the application of the 250 pound force described above, requires that the press bar operate at a force of less than 50 lbs. This press bar force augments the 250 pound force mentioned above so that the total outward force on the latch can be up to 300 pounds. To counter this enormous force in the opening direction, designers of exit devices have avoided the preferred, more secure reciprocating deadbolt due to the high lateral friction generated under such conditions, and have adopted pivoted latchbolts.

In other words, while rectangular or square deadbolts, as known in the lock industry, offer better strength and security, they require a substantial force to slide them to retracted position under the above extreme conditions because of the large perpendicular forces acting on the bearing surfaces. Because failure of an exit device to open could be catastrophic, the preference for square or rectangular deadbolt-type locking members has been cast aside for the easier-opening pivoted latchbolt. The latchbolts have strike-engaging latching surfaces which are curved or beveled, thereby easing the resistance to retraction in the keeper as the door and exit device are pressed outward, but exerting lateral forces when the door is under pressure which separate the door and the frame thereby reducing door security. As a result, doors equipped with pivoted latchbolts have been more vulnerable to vandalism. Also, in fire situations in which enormous heat has warped the door and frame, pivoted latchbolts have been known to fail and pop open during fire tests.

For the foregoing reasons there is a need for an exit device which provides the security of a deadbolt while at the same time being operable under conditions of high outward force.

SUMMARY

An exit device for a door comprising a securing member assembly overcomes the aforementioned problems through the provision of an elongated securing member, such as a deadbolt or the like, for extending into a keeper mounted adjacent a free end of the door, the elongated member moveable longitudinally from an extended position to a retracted position; a pivoting member having a peripheral surface, the peripheral surface engaging a surface of the elongated securing member as the pivoting member pivots for retracting and supporting the elongated securing member from a direction opposite the direction the door opens; and means for actuating the pivoting member for moving the elongated member from the extended to the retracted position, the elongated member returning to the extended position when the press bar is released.

The actuating means of the securing member assembly may comprise, for example, a press bar assembly operatively connected to the pivoting member or elongated member whereby the press bar, when pressed, will move the elongated member longitudinally from extended to retracted position. The pivoting member serves as an anti-friction bearing roller to shoulder the inward force of the elongated securing member during its retraction as the door is pushed open and the elongated securing member is pressed hard outward against its keeper in the door frame.

Further, the pivoting member may further comprise a keeper-engaging surface for engaging a keeper and pivoting the pivoting member to retract the elongated securing member as the door is closed. The pivoting member also serves as an anti-friction device as the door closes to retract the elongated securing member as the keeper-engaging surface on the pivoting member forces the pivoting member to pivot and in turn drives back the elongated securing member.

The securing member assembly for the exit device of the present invention may further comprise means for effecting deadlocking of the elongated securing member in the extended position and means for canceling deadlocking of the elongated member.

Using an elongated securing member gives a mortise-lock degree of security to a surface-mounted exit device.

Accordingly, it is an object of this invention to provide an exit device having an elongated securing member, such as a deadbolt or the like, as its securing member.

A further object of this invention is to provide an exit device having a deadbolt as its securing member wherein the deadbolt is mounted adjacent a free end of the door for longitudinal movement from an extended to a retracted position.

A still further object of this invention is to provide an exit device having a deadbolt as its securing member which does not require substantial force to move the deadbolt from the extended to the retracted position.

Another object of this invention is to provide an exit device having a deadbolt as its securing member for a door having a press bar on the inside of the door to actuate the deadbolt.

Still another object of this invention is to provide an improved exit device having a deadbolt as its securing member which will meet the aforementioned requirement of opening under conditions of great outward force on the door and exit device.

A related object of this invention is to provide an improved exit device for a door having a press bar on the inside of the door to actuate the deadbolt, the door opening with minimal pressure on the press bar despite great outward force on the door.

Yet another object of this invention is to provide an exit device having an improved degree of security.

Similarly, an object of this invention is to provide an improved exit device which is less vulnerable to vandalism.

With more particularity, it is an object of this invention to provide an improved exit device having a deadbolt as its securing member with a deadlocking feature.

A feature of this invention is an elongated member, such as a deadbolt or the like, as the securing member of an exit device.

A further feature of this invention is a pivoting member which upon actuation drives the deadbolt into a retracted position.

A still further feature of this invention is linking means connecting the press bar and deadbolt whereby when the press bar is pressed the deadbolt will move longitudinally from extended to retracted position.

Another feature of this invention is the pivoting member, generically referred to herein as a retractor blade, which serves as an anti-friction bearing roller to bear the force against the deadbolt in the door opening direction during retraction of the deadbolt as the door is pushed open and the deadbolt is pressed against its keeper.

A related feature of this invention is a bearing surface on the retractor blade bearing against a surface of the deadbolt for progressively rolling along the deadbolt surface as the deadbolt is retracted.

Still another feature of this invention is a keeper-engaging surface on the retractor blade which progressively engages the keeper as the door is closed and forces the retractor blade to pivot and retract the deadbolt.

The present invention has many advantages, including providing a more secure exit device than previously known as a result of the use of the deadbolt as the securing member.

BRIEF DESCRIPTION OF THE DRAWINGS

These and other features, aspects and advantages of the present invention will become better understood with regard to the following description, appended claims, and accompanying drawings where:

DESCRIPTION

As used herein, the term "deadbolt" means an exit device component having an elongated end which projects from a free end of a door in an extended position, is withdrawn into the exit device in a retracted position by action of the exit device, and extends into a hole provided in the strike or keeper when the door is closed for securing the door in the closed position.

Figure 1:
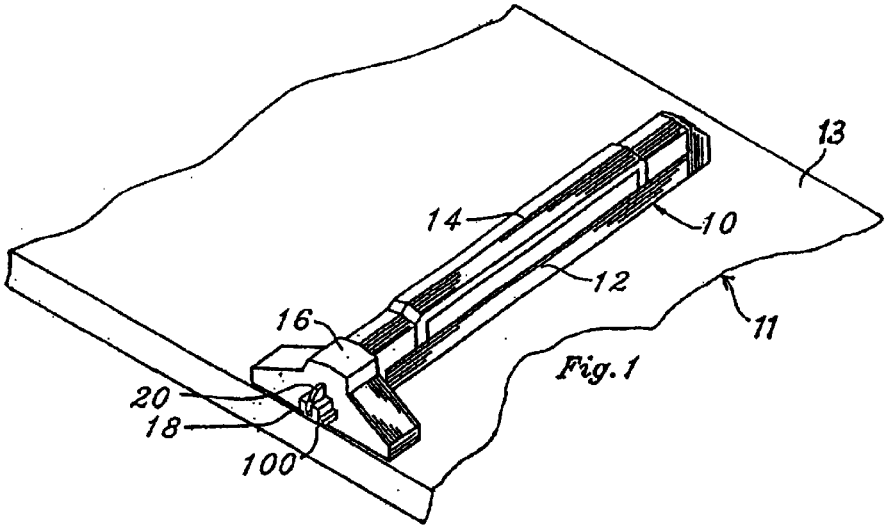
FIG. 1 is a perspective view of an exit device embodying features of the present invention and shown in position on a cut-away portion of a door.

An embodiment of to invention is shown in FIG. 1 and is generally designated 10. The exit device of the present invention is adapted to be mounted on a surface door 11 which is the trailing surface 13 of the door as the door 11 pivots in a direction from a closed position to an open position. The exit device 10 comprises an elongated housing 12 with a press bar 14 and a latch cover 16. Out of to latch cover extends a deadbolt 18, a retractor blade 20, as shown, and a deadlocking plunger 100.

Figure 2:
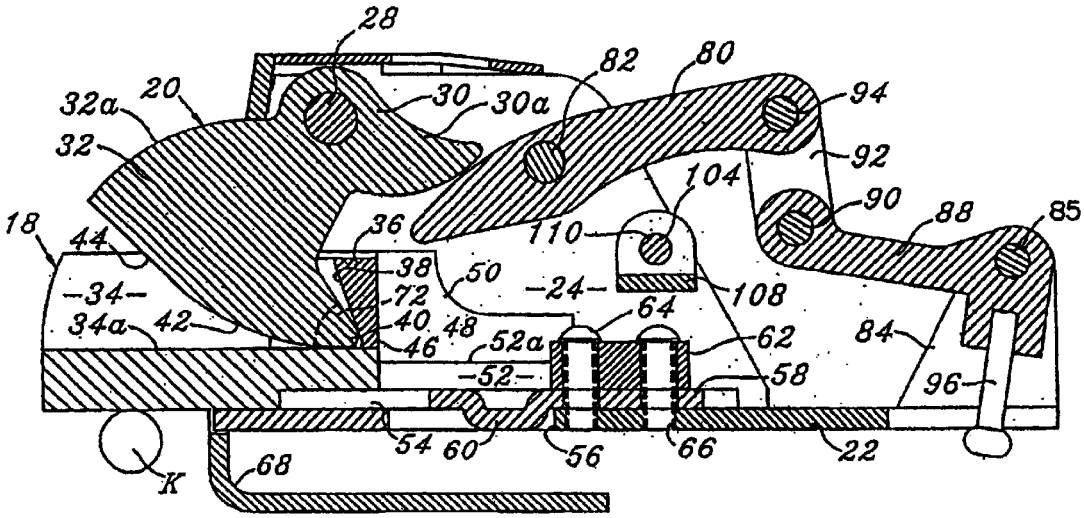
FIG. 2 is a sectional view taken on line 2—2 of FIG. 7 of an embodiment of the actuator of the exit device of FIG. 1 showing the deadbolt extended as with the door opened.

As seen in FIG. 2 with the latch cover 16 removed, the latch actuator comprises a base plate 22 having side plates 24 and 26. Parallel to and spaced above the base plate 22 is a blade pivot pin 28 which is sturdily secured between the side plates 24, 26. Pivotally mounted on the pin 28 is the retractor blade 20 which comprises an enlarged hub 30 with a transverse bore accepting the pin 28 and a thin blade portion 32 having a keeper contact surface 32*a*.

Disposed under the retractor blade 20 and resting on the base plate 22 is the deadbolt 18 which has on its forward upper surface a separate longitudinal cut-out 34 loosely receiving the blade portion 32. Spaced back from the front end of the deadbolt the cut-out 34 is enlarged laterally and receives an insert 36 preferably of sintered metal. As shown, the insert is formed with an inclined wall 38. The rearward end of the retractor blade 20 is formed with a nose 40 which butts against the surface of the inclined wall 38. The periphery of the blade portion 32 extends forward from the nose 40 in an arc 42 concentric with the axis of the pin 28. The arc transforms partway forward from the nose into a straight line 44.

The insert 36 backs up on a pair of spaced shoulders 46 on either side of a longitudinal cut-out 48 (FIG. 7) midway along the length of the deadbolt. The cut-out 48 is formed with opposed faces 50 which jog inward spaced from the bottom of the bolt to present flanges 52. The flanges in their inner most faces are spaced from each other and parallel thereto. Upwardly facing shoulders 52*a* are presented on top of the flanges.

Spaced back from the front end of the deadbolt its undersurface is upwardly recessed as at 54 from its midsection to its rear end. The base plate 22 is formed with a window 56 and a bolt plate 58 having a downward offset 60 dipping into the window 56 which overlies the base plate 22 from the window 56 rearward.

Figure 9:
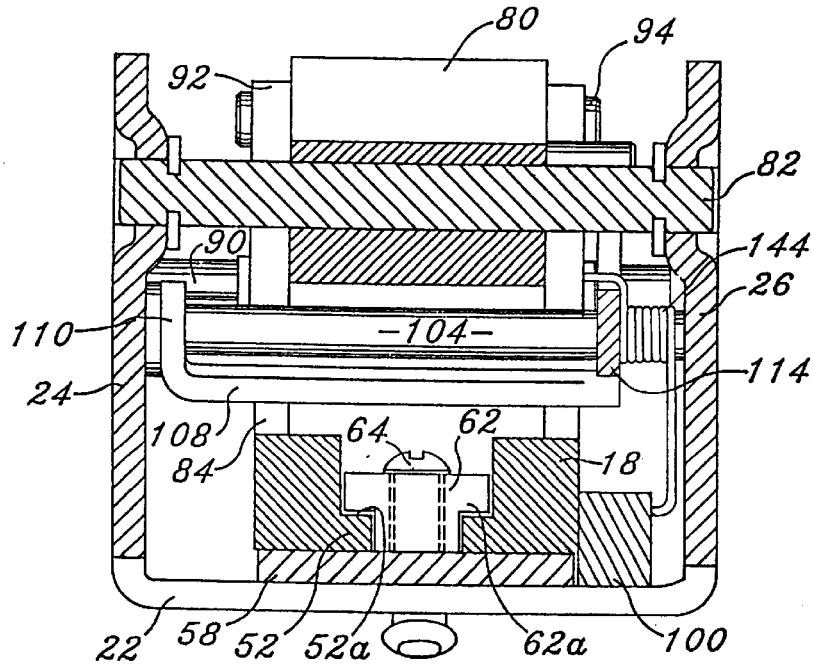
FIG. 9 is an enlarged sectional view taken on the line 9—9 of FIG. 4.

Surmounting the bolt plate 58 is a T-shaped deadbolt stabilizer 62 (FIG. 9). The three elements: base plate 22, bolt plate 58 and the T-shaped stabilizer 62 are clampingly secured together by a pair of bolts 64 which extend through apertures in the stabilizer 62 and the bolt plate 58 and are threaded into the base plate holes 66. A mounting plate 68 (FIG. 7) is secured to the base plate 22 and has an opening 70 therein to pass the front end of the deadbolt 18.

Figure 7:
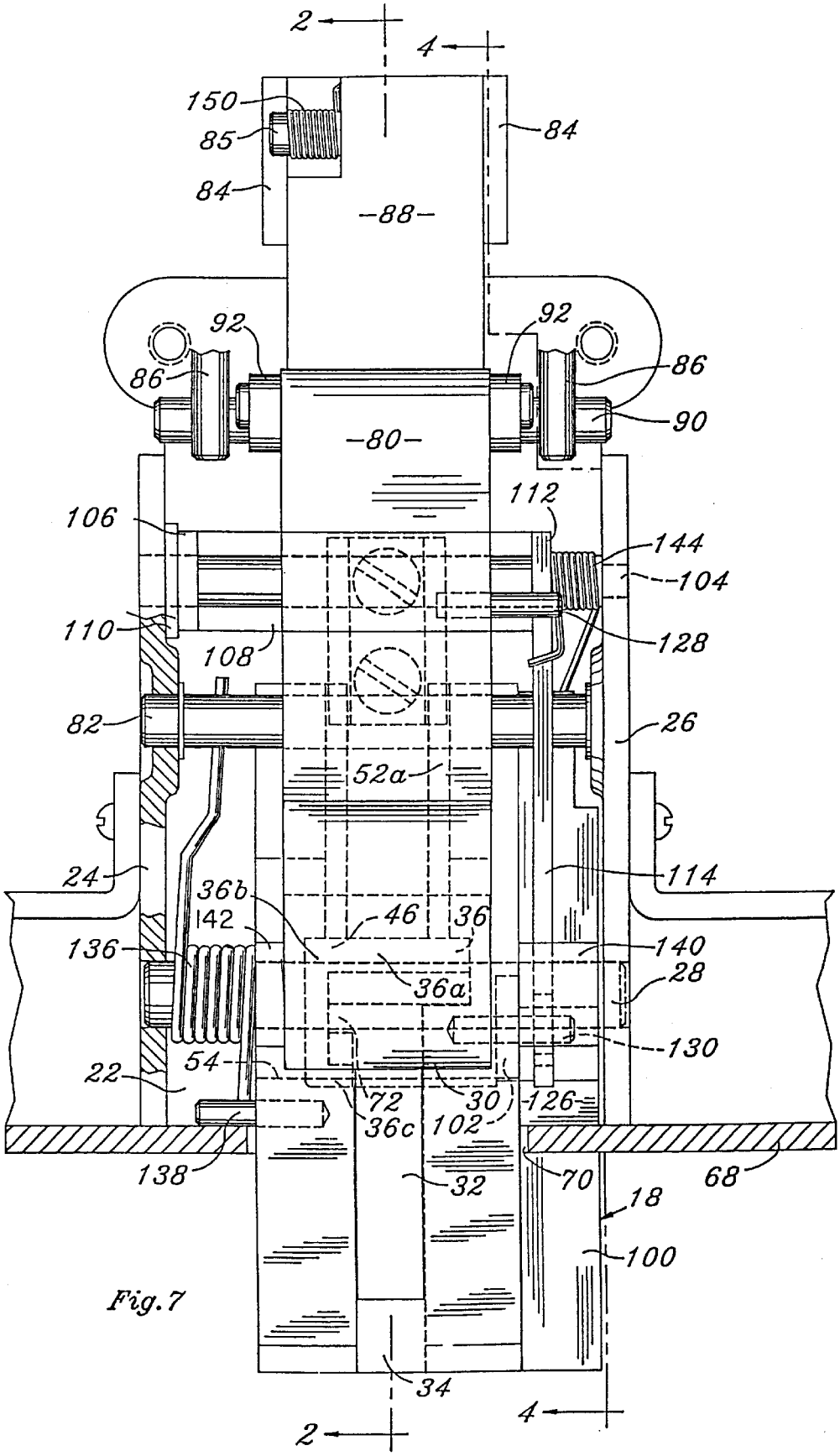
FIG. 7 is a top plan view of the parts of FIG. 2 with the deadbolt extended.

The retractor blade 20 has extending laterally form its nose area 40 a lug 72 (FIGS. 2, 8) which provides a connection for interrelated movement between the retractor blade 20 and the deadbolt 18. As best shown in FIG. 7, the insert 36 which nestles in its recess in the deadbolt has rear wall 36*a*, side wall 36*b* and a partial front wall 36*c*.

While the front end of the deadbolt is partly retained in position by the configuration of the opening 70 in the mounting plate 68, the rear end is stabilized by the stabilizer 62. As shown best in FIG. 9, the flanges 62*a* comprising the upper portion of the T-shaped stabilizer 62 overlie at the upwardly facing shoulders 52*a* on flanges 52 in the cut-out 48 at the rearward end of the deadbolt. Thus, the deadbolt is able to travel in a controlled longitudinal direction from extended to retracted position and back again.

Figure 3:
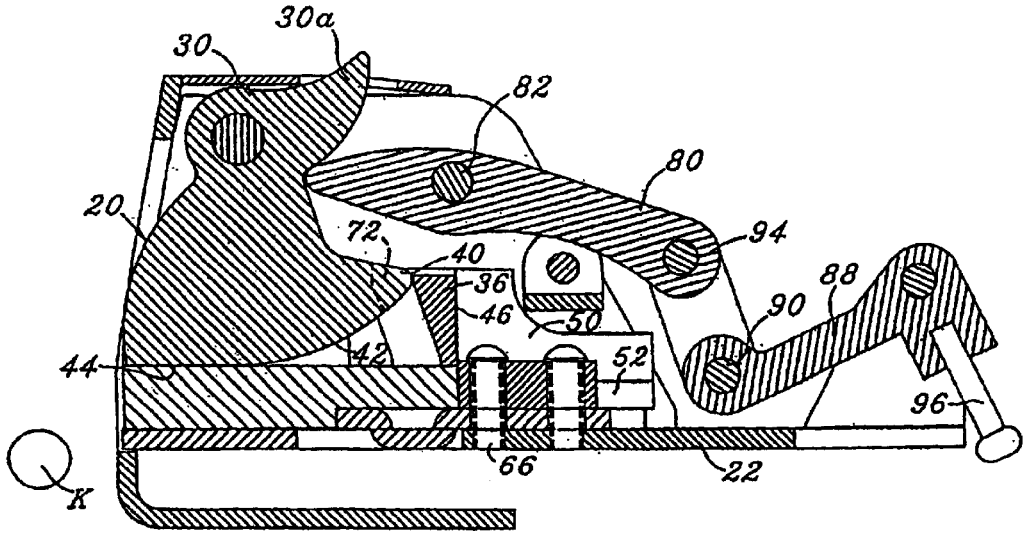
FIG. 3 is similar to FIG. 2 but showing the deadbolt retracted as when the press bar is depressed.

As shown in FIGS. 2 and 3, the retraction of the deadbolt may be driven by the retractor blade 20 as its lobe 30*a* is raised by linkages to be described. As the nose 40 of the retractor blade 20 drives into the rear wall 36*a* of the insert 36 it moves the deadbolt toward retracted position. Engagement of the lug 72 with the front wall 36*c* of the insert, assures that the retractor blade will not extend when the deadbolt is retracted.

When there is an inward force on the deadbolt all during the relative movement of the retractor blade 20 and the deadbolt 18, the periphery surface 42 of the retractor blade bears on the bearing surface floor 34*a* of the cut-out 34. Thus, the great bearing force tending as in the panic situation described above to move the deadbolt from its bolt plate 58 is countered by the reaction of the surface 42 of the retractor blade 20 against the floor 34*a* and the pivot pin 28.

Part of the linkage between the press bar and the retractor blade 20 is a retractor lever 80. This is pivoted intermediate its ends on a pin 82 sturdily bridging between the side plates 24, 26 rearward of the retractor blade. The upper surface of the leftward side (FIG. 2) of the retractor lever 80 is shaped to engage and press underneath the lobe 30*a* of the retractor blade 20 so that when the rightward side of the retractor lever 80 is depressed, the leftward side urges the lobe 30*a* upward, rotating the retractor blade in counter-clockwise motion as seen in FIG. 2.

A parallel pair of ears 84 extend upward from the base plate 22 to the rightward side of the side plates 24, 26 (FIG. 2). These ears are formed with aligned openings in which is secured a pin 85. To the pin 85 is pivotally secured a dog-bone lever 88 which has a leftward side through which extends a pin 90. Pivoted links 92 extend on either side of the lever 80 and dog-bone lever 88 connecting the pin 90 and a pin 94, the latter extending through the rightward end of the retractor lever 80.

Downward motion of the rightward side of lever 80 is accomplished when the press bar is pushed in as in opening the door. The press bar has a pair of fingers 86 (FIG. 7) and these engage the upper side of the extensions of pin 90. The downward side of the dog-bone lever 88 includes a headed projection 96 as is well known in the art by which the outside cylinder or other operator for the exit device may actuate the deadbolt. The connection between the outside cylinder and the headed projection 96 will not be described herein, it being well disclosed in the Heid patent mentioned above.

Figure 8:
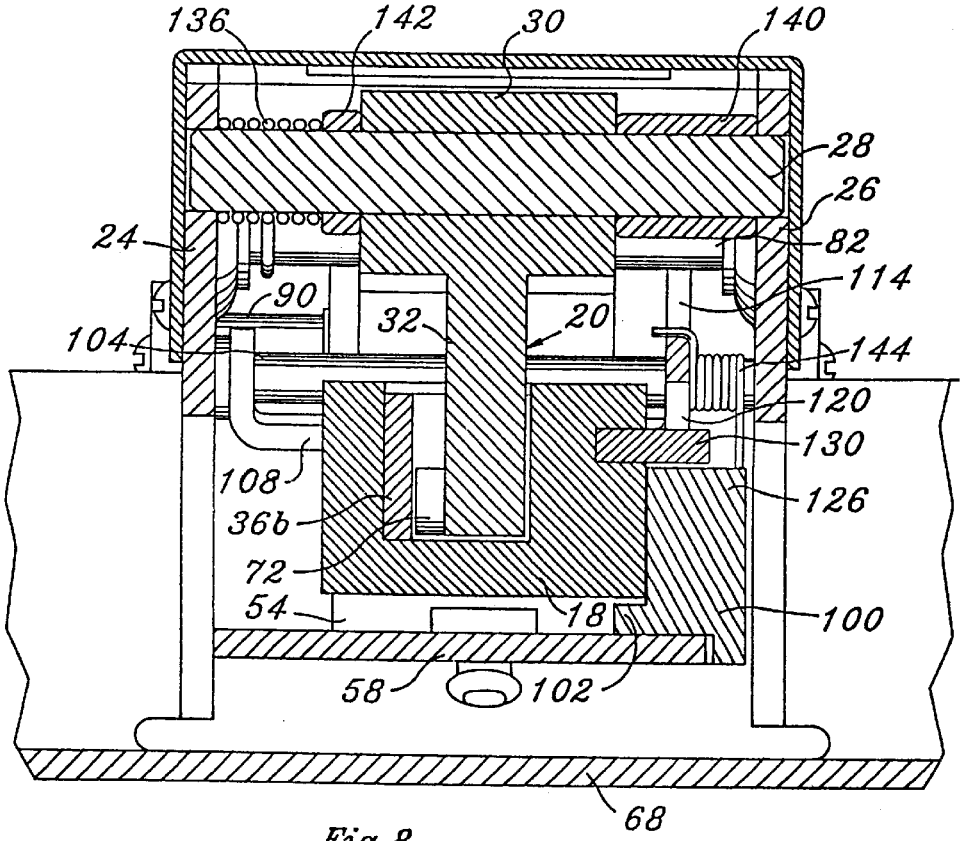
FIG. 8 is an enlarged sectional view taken on the line 8—8 of FIG. 4.

Deadlocking plunger 100 operates in a manner well known in the art. Briefly, it is an elongated element which is contiguous to a side of deadbolt 18 (FIG. 8). It moves or is moved from an extended position shown in FIG. 4 to a retracted position shown in FIG. 5. Intermediate its ends it is formed with a foot 102 which fits into the recess 54 on the underside of the deadbolt 18 (FIG. 2). Otherwise, the deadlocking plunger is stabilized by the inner side of the side plate 26 and the shape of the opening in the cover 16 as shown in FIG. 1 and as is conventional.

Figure 4:
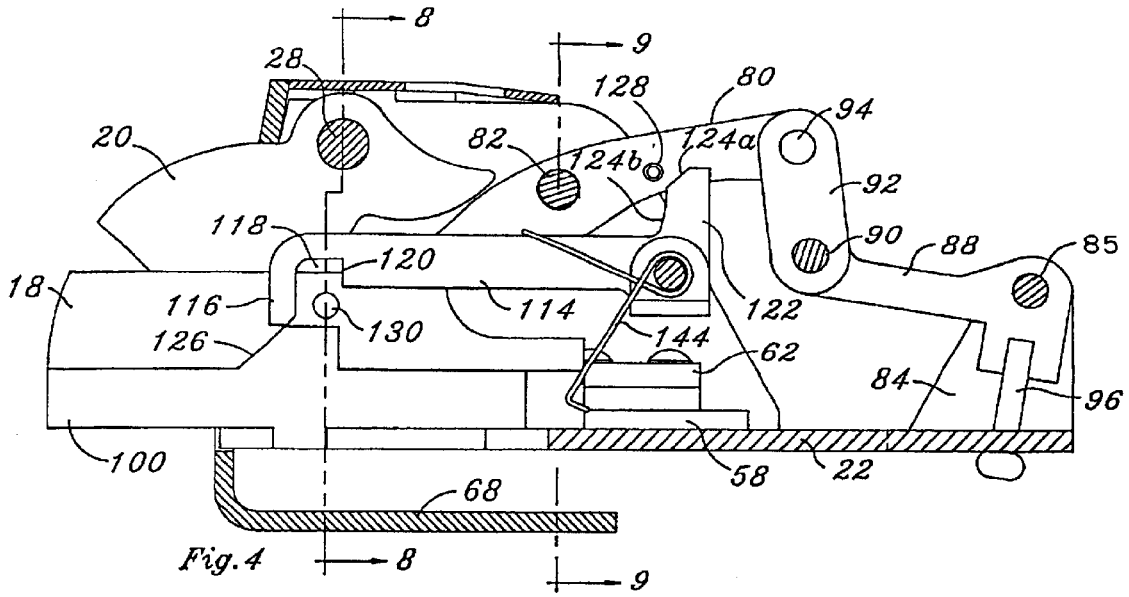
FIG. 4 is a sectional view taken on the line 4—4 of FIG. 7 showing the deadbolt extended as in FIG. 2 and showing the deadlocking plunger extended.
Figure 5:
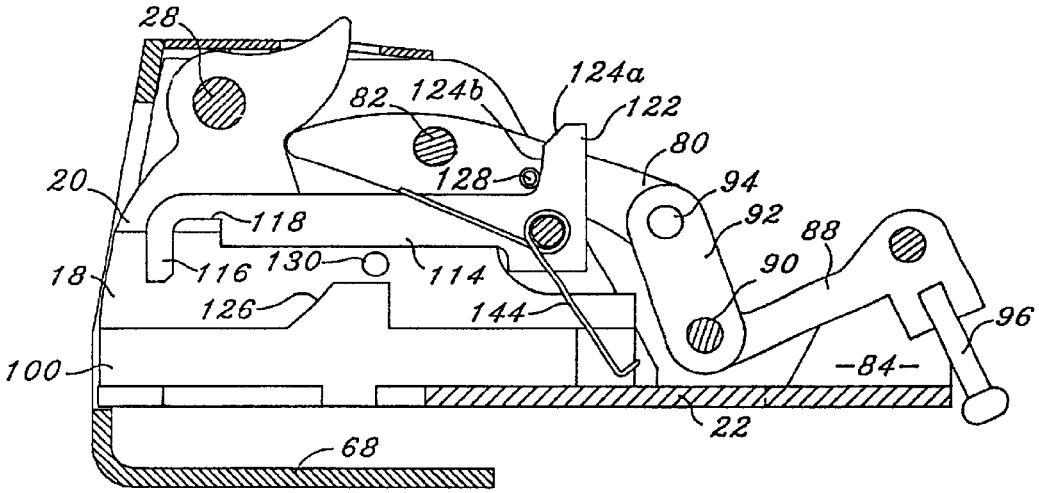
FIG. 5 is similar to FIG. 4 but showing the parts as with the exit device press bar depressed.

The deadlocking linkage includes a pin 104 which extends between the side plates 24, 26 and journals the yoke 106 which is of U-shape having an elongated bight 108 (FIG. 9) and upward legs 110, 112. The leg 112 has a long forward extension forming a deadlocking arm 114 for effecting deadlocking of the deadbolt (FIG. 4). For this purpose, the distal end of the deadlocking arm 114 has a downward toe 116 and a downwardly facing notch 118 which includes a blocking surface 120 for deadlocking of the deadbolt when the deadbolt is in the keeper as will be described below. Leg 112 also has an upward drive arm 122 (FIG. 4) terminating in a cam surface 124 including an inclined portion 124*a* and a generally vertical portion 124*b*.

The deadlocking plunger 100 is formed with a trapezoidal upward cam 126 (FIG. 4) intermediate its ends, and the retractor lever 80 is formed with a transverse pin 128, the trapezoidal cam 126 and the transverse pin 128 forming first and second actuator means, respectively, for the deadlocking linkage as will be explained. Beefy deadlocking pin 130 extends out transversely from the deadbolt 18 (FIG. 4).

Various springs are provided. A torsion spring 136 winds around the pin 28 on the leftward side of the deadbolt 18 (FIG. 7). One end of the spring 136 rests under the pin 82 and the other end engages under a pin 138 which extends out from the leftward side of the deadbolt 18 (FIG. 7). The spring 136 is under stress so that it biases the deadbolt 18 in the extended position, and pin 138 additionally provides a stop, hitting against the mounting plate 68 to limit the extension of the deadbolt.

Spacer 140 surrounds the pin 28 on the rightward side of the hub 30 of the retractor blade and a smaller spacer 142 (FIG. 8) is disposed between the spring 136 and the leftward side of the hub 30, both to suitably position the retractor blade 20 so that the blade portion 32 is aligned with the cutout 34 in the deadbolt.

A second spring 144 (FIG. 7) is a torsion spring which is disposed about the deadlocking linkage pin 104. Its purpose is to bias the deadlocking arm 114 downward so that the notch 118 receives the pin 130. One end of the spring 144 engages over the top of the arm 114 while the other end engages the rear surface of the deadlocking plunger 100. The spring 144 is under stress to bias the arm 114 as described. The other end of the spring 144 pushes outward against the deadlocking plunger 100.

A third torsion spring 150 (FIG. 7) biases the dog-bone lever in a clockwise direction (FIG. 4).

The general operation of a deadlocking mechanism is well known to those skilled in the art. In the embodiment described, when both the deadbolt 18 and the deadlocking plunger 100 are extended (FIG. 4), the trapezoidal cam 126 of the plunger engages the toe 116 of the deadlocking arm 114 to hold the notch 118 and blocking surface 120 up clear for canceling the deadlocking action of the deadlocking arm 114 and allowing for the rearward movement of the deadbolt pin 130. The deadbolt, thus, is free to retract on the closing of the door, being driven by the engagement of the keeper roller K (FIG. 2) with the curved front keeper contact surface 32*a* of the blade portion 32. In this scenario, the keeper roller K forces the retractor blade in counterclockwise direction so that its nose 40 engages the surface of the inclined wall 38 of the insert 36 which is part of the deadbolt and drives the latter toward retracted position. Engagement of the front end surface of recess 54 in the underside of the retracting deadbolt with the foot 102 on the plunger drives back the deadlocking plunger 100. Once the deadbolt is past the keeper roller K, it snaps outward being driven out by spring 136 to lock the door.

Figure 6:
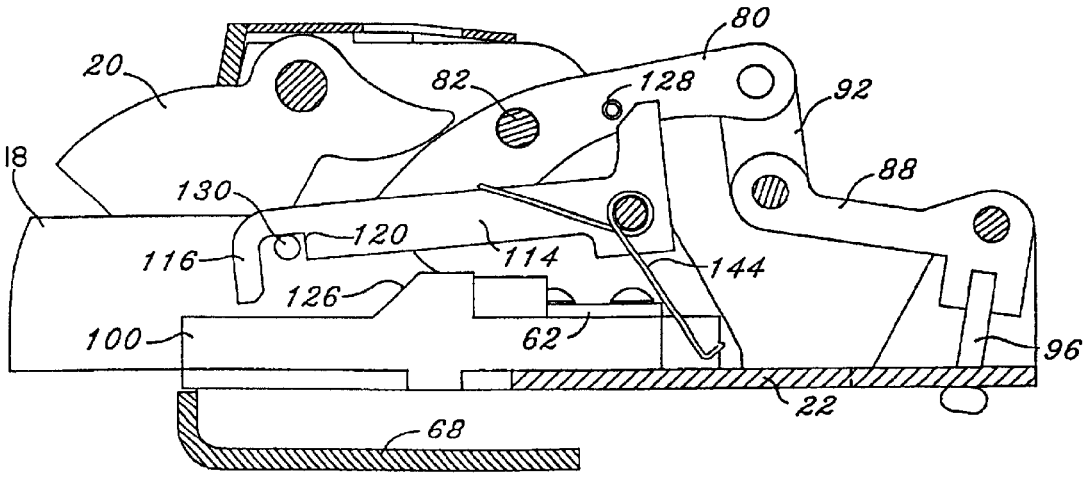
FIG. 6 is similar to FIG. 4 but showing the parts as with the door closed and the deadbolt in the deadlocking position on the door frame and the deadlocking plunger abutting the strike plate.

Because the opening in the keeper permits the intrusion of the deadbolt 18 but not the deadlocking plunger 100, the latter cannot extend and, hence, the cam 126 is rearward of the toe 116 (FIG. 6) and the deadlocking arm 114 rests with the top of the notch 118 on the pin 130 so that attempts to violate the lock by forcing the deadbolt inward are frustrated as the pin 130 hits the blocking surface 120. Recess 54 which encloses foot 102 on the deadlocking plunger 100 is long enough to permit the deadbolt to extend while the deadlocking plunger 100 is held by the strike in depressed or nearly depressed condition.

Upon the actuation of the press bar 14, the pins 86 (FIG. 7) press the ends of the sturdy pin 90 downward, rotating the retractor lever 80 in a clockwise direction. This causes the transverse pin 128 to move against the cam surface 124*a*, 124*b* of the upward driver arm 122 and pivot the deadlocking arm 114 in a clockwise direction raising the arm 114 so that the notch 118 raises (FIG. 5), moving the blocking surface 120 out of the path of the pin 130 thereby canceling the deadlocking action of the deadlocking arm 114 and allowing for subsequent retraction with the deadbolt 18. Continued movement of the press bar causes the top of the leftward side of the retractor lever 80 to work under the lobe 30*a* of the retractor blade 20 causing its counterclockwise rotation. As will be understood by now, the nose 40 works against the wall of the 38 of the insert 36, part of the deadbolt 18, to retract the deadbolt. Engagement of the front end surface of recess 54 in the underside of the retracting deadbolt with the foot 102 on the deadlocking plunger 100, drives back the deadlocking plunger.

At all times during which pressure is put on the trailing face 13 of the door 11 with the deadbolt in its keeper, the bearing surface 42 of to retractor blade 20 bears against the surface 34*a* of the floor of the cutout 34 and the pivot pin 28. This provides an anti-friction means for overcoming what can be a very substantial bowing force working to displace the deadbolt inward as force is exerted inward by the keeper roller K.

Clearly, once the front of the deadbolt 18 clears the keeper roller K, the door is free to move open. When pressure is released from the press bar, the spring 136 drives the deadbolt outward and spring 144 drives the deadlocking plunger 100 outward. The lock returns to the condition described and as shown in FIGS. 2 and 4.

Figure 10:
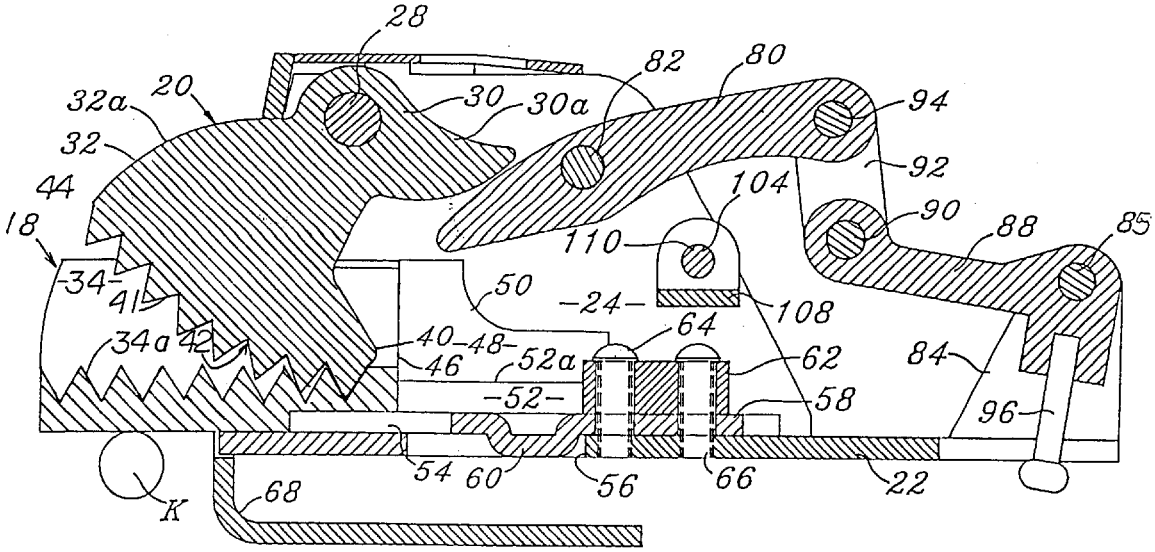
FIG. 10 is a sectional view of another embodiment of the exit device of FIG. 1 showing the deadbolt extended as with the door opened.
Figure 11:
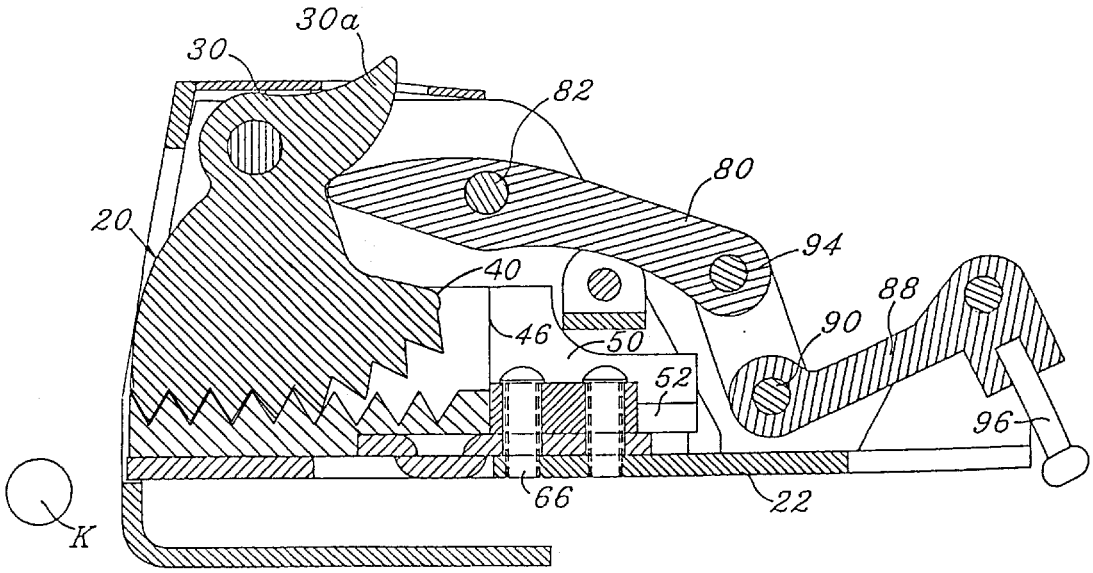
FIG. 11 is similar to FIG. 10 but showing the deadbolt retracted as when the press bar is depressed.
Figure 12:
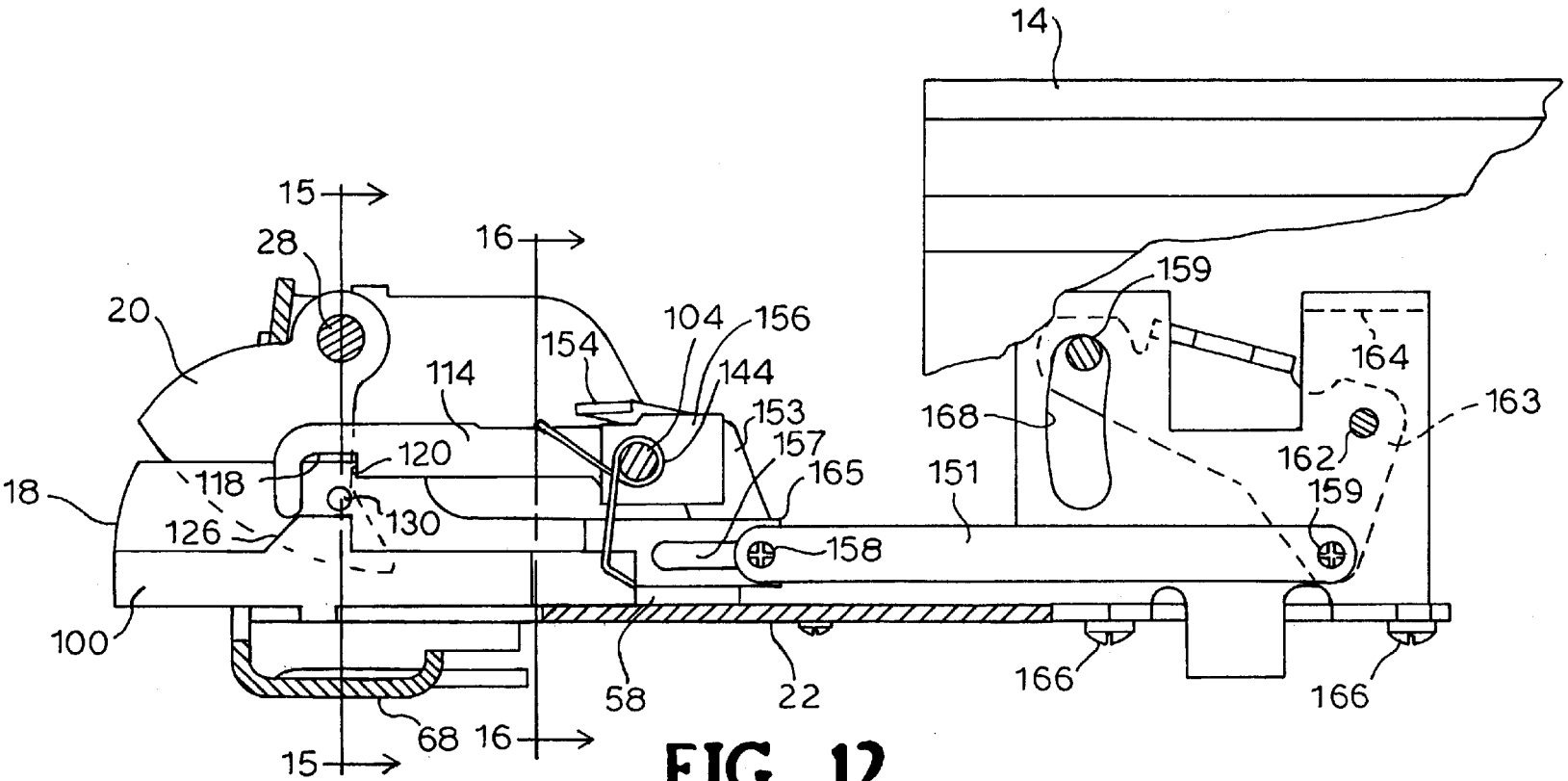
FIG. 12 is a sectional view of still another embodiment of the exit device of FIG. 1 showing the deadbolt extended and showing the deadlocking plunger extended.

Another embodiment of the present invention is shown in FIGS. 10 and 11. In this embodiment, the arc 42 of the periphery of the blade portion 32 is formed with teeth 41 defining the arc segment of a gear. The surface 34*a* of the longitudinal cut-out 34 is also formed with teeth which define a toothed rack. The teeth 41, 34*a* provide a connection for interrelated movement between the retractor blade 20 and the deadbolt 18.

In operation, the retraction of the deadbolt 18 is driven by the retractor blade 20 as its lobe 30*a* is raised by the linkages described above. As the teeth 41 of the retractor blade 20 progressively engage the teeth 34*a* of the deadbolt, the pivoting retractor blade 20 drives the deadbolt toward the retracted position. Engagement of the teeth 41, 34*a* assures that the retractor blade will not extend when the deadbolt is retracted.

Similarly, when the door is closed the keeper roller K forces the retractor blade 20 in a counter-clockwise direction so that the teeth 41, 34*a* progressively engage and drive the deadbolt toward the retracted position. Engagement of the front end surface of recess 54 in the underside of the retracting deadbolt with the foot 102 on the plunger drives back the deadlocking plunger 100. Once the deadbolt is past the keeper roller K, it snaps outward being driven out by spring 136 to lock the door.

Another embodiment of the present invention is shown in FIGS. 12–16. In this embodiment, the deadbolt 18 is retracted by means of linkages between the press bar 14 and the deadbolt 18. For this arrangement, a U-shaped deadbolt extension 165 is mounted on the rear end of the deadbolt 18. Retractor links 151, 152 are slidingly mounted in longitudinal slots 157 in each of the rearwardly extending legs of the deadbolt extension 165 using a link pin 158. The rearward ends of the retractor links 151, 152 are secured to a press bar lever 163 by means of a pivot pin 159. The press bar lever 163 rotates on a pin 162 in a housing 164 which is mounted to the base plate 22 by screws 166. A cross-pin 159 is fixed to depending sides of the press bar 14 and passes through an arcuate slot 168 in the housing 164.

Figure 13:
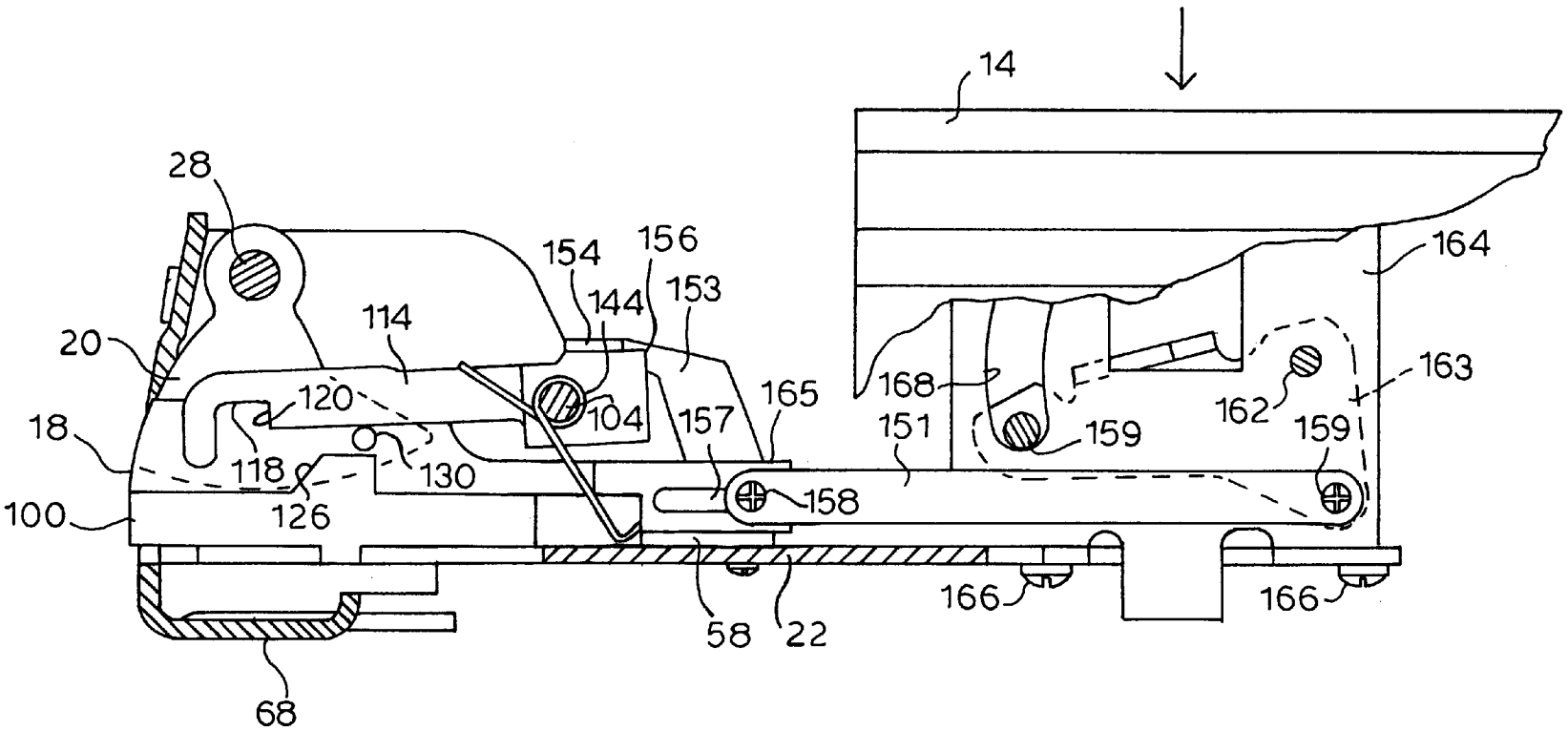
FIG. 13 is similar to FIG. 12 but showing the parts as with the exit device press bar depressed.
Figure 14:
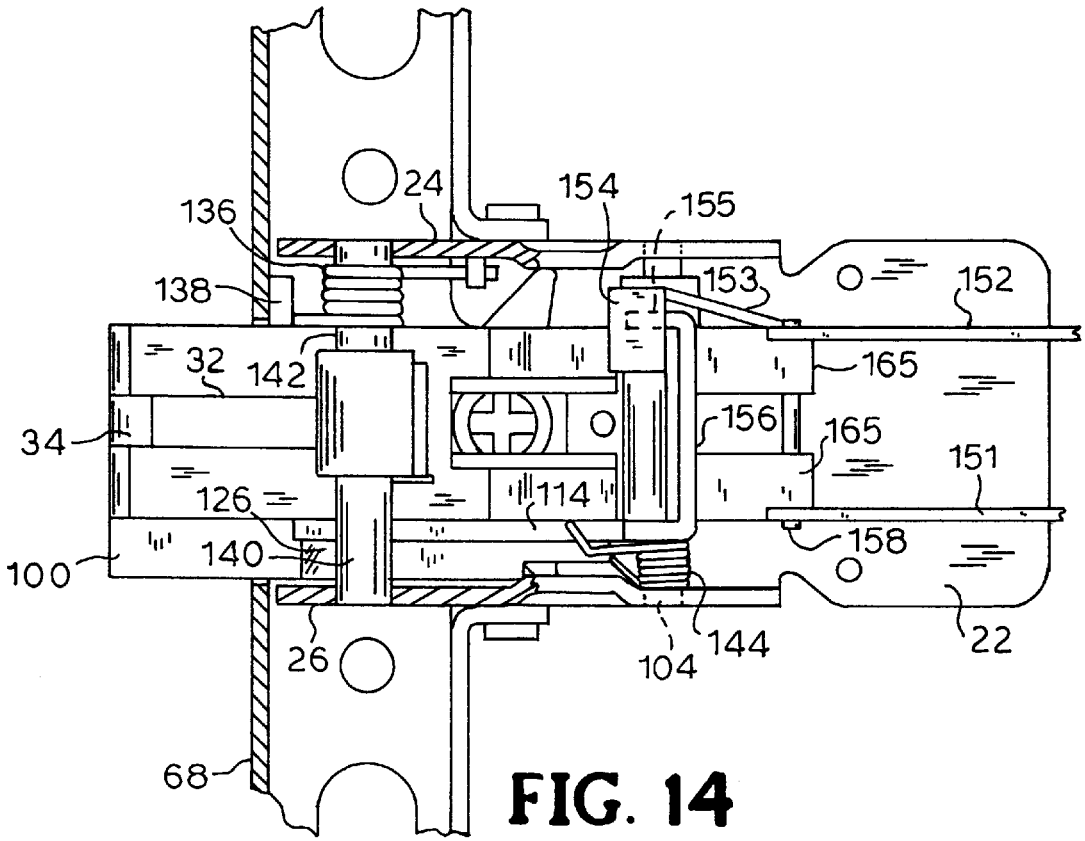
FIG. 14 is a top plan view of the parts of FIG. 12 with the deadbolt extended.
Figure 15:
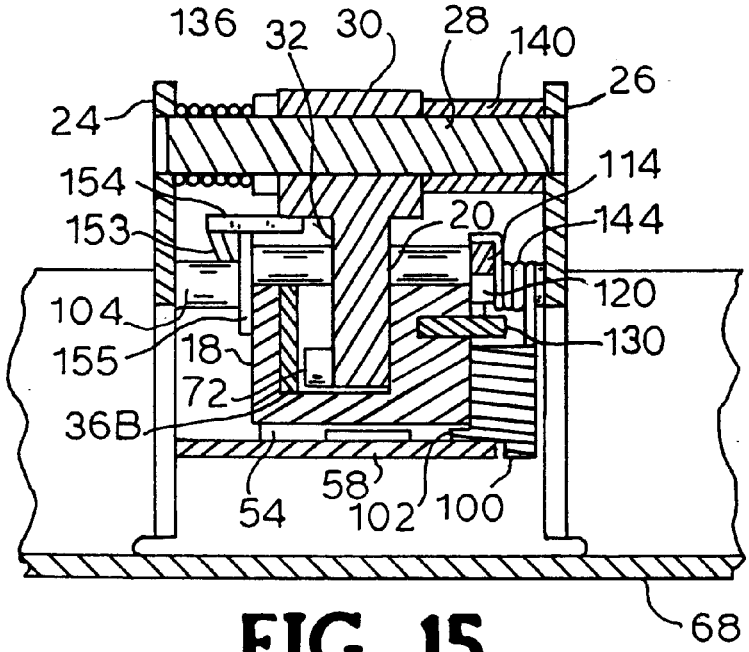
FIG. 15 is an enlarged sectional view taken on the line 15—15 of FIG. 12.
Figure 16:
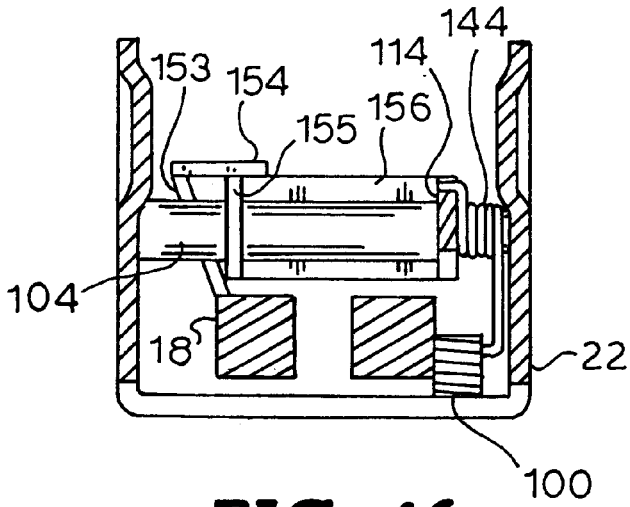
FIG. 16 is an enlarged sectional view taken on the line 16—16 of FIG. 12.

As seen in FIG. 13, when the press bar 14 is depressed, the retractor lever 163 rotates in a counterclockwise direction. This draws the retractor links 151, 152 rearward thereby retracting the deadbolt 18. Engagement of the front end surface of recess 54 in the underside of the retracting deadbolt 18 with the foot 102 on the plunger 100 drives back the plunger. As described above, the retractor blade 20 is also drawn into retracted position since the retractor blade 20 and the deadbolt 18 are connected for interrelated movement by the engagement of the lug 72 with the front wall 36*c* of the insert. Alternatively, it is understood that interrelated movement between the retractor blade 20 and the deadbolt 18 may be accomplished by forming the arc 42 of the periphery of the blade portion 32 and the surface 34*a* of the longitudinal cut-out 34 with interengaging teeth.

The retractor blade 20 also functions as described above upon closing of the door to retract the deadbolt 18. The slots 157 in the deadbolt extension 165 are long enough to allow the deadbolt 18 to move to the retracted position without the deadbolt extension 165 engaging the link pin 158.

The deadlocking linkage pin 104 journals a yoke 156 which is of U-shape having forward legs 155, 114. The long, forwardly extending leg 114 forms a deadlocking arm for effecting deadlocking of the deadbolt 18 as in the previously described embodiments. The shorter leg 155 defines a deadlocking release arm. One of the retractor links 152 includes an extension 153 having a release actuator 154 positioned above leg 155 of the yoke 156.

Upon the actuation of the press bar 14, the retractor links 151, 152 are drawn rearward causing the release actuator 154 to move against the leg 155 of the yoke 156 and pivot the deadlocking arm 114 in a clockwise direction raising the arm 114. With the arm 114 raised, the blocking surface 120 is moved out of the path of the pin 130 thereby canceling the deadlocking action of the deadlocking arm 114 and allowing for subsequent retraction with the deadbolt 18. Continued movement of the press bar draws the deadbolt 18 to the retracted position.

The provision of the retractor blade 20 and its bearing surface 42 make possible the use of a deadbolt in the present exit device. Repeating, the rolling surface 42 and pivot pin 28 effectively oppose the pressure (FIG. 1) exerted by the keeper roller K tending to displace the deadbolt inward against adjacent structures. By means of the retractor blade with its bearing surface and pivot pin, the industry is finally able to have an exit device featuring a deadbolt as its securing means with the concomitant improvement in security. If desired or necessary, anti-friction coatings may be used on the deadbolt and other parts to reduce friction and make the operation even smoother.

Although the present invention has been described in considerable detail in connection with a preferred embodiment thereof, it will be understood, of course, that I do not intend to limit the invention to that embodiment since modifications may be made by those skilled in the art, particularly in light of the foregoing teachings. For example, an exit device having a deadbolt as its securing is effective where any type of activating means is employed for pivoting the retractor blade, including vertical door rod exit devices. On the contrary, I intend to cover all alternatives, modifications and equivalents as may be included within the spirit and scope of the invention as defined by the appended claims. It is, therefore, contemplated by the appended claims to cover any such modifications as incorporating those features which constitute the essential features of these improvements within the true spirit and scope of the invention. Therefore, the spirit and scope of the appended claims should not be limited to the description of the preferred embodiment contained herein.

I claim:

1. In combination:

a pivoting door, the door having a hinged edge and a free edge and a major surface comprising a door face which is the trailing surface of the door as the door pivots in a direction from a closed position to an open position; and an exit device, the exit device comprising a. a frame including a base plate having a longitudinal axis and side plates secured to and extending up on either aide of the base plate, the frame mounted to the door face which is the trailing surface of the door, b. a pin secured to and extending between the side plates spaced from the base plate, c. a deadbolt between the pin and the base plate, the deadbolt having a longitudinal axis parallel to the longitudinal axis of the base plate and slidable longitudinally with respect to the base plate from an extended position, where the deadbolt is adapted to be received in a keeper mounted adjacent the free edge of the door when the door is in the closed position, to a retracted position and having an abutment surface, d. a retractor blade pivotally mounted on the pin for movement from an extended position to a retracted position, the retractor blade including a periphery having a nose adapted to engage the abutment surface, a deadbolt pressure surface extending along the periphery from the nose and adapted as the retractor blade pivots and the deadbolt slides to roll progressively along a longitudinal surface on the deadbolt, and a strike-plate-engaging surface for engaging a strike plate as the door closes for pivoting the retractor blade to the refracted position as the nose engages the abutment surface and retracts the deadbolt, e. a manually operated press bar assembly is disposed on trailing surface of the door mounted on the frame and operatively connected to the deadbolt so that when the press bar is pushed the deadbolt slides to the retracted position while supported by the retractor blade for minimizing the force necessary to move the deadbolt to the retracted position as the door is pushed open under conditions of high outward force on the door and exit device by countering the inward force on the deadbolt and defeating friction generated as the deadbolt is pressed outward against the keeper, and f. a spring for urging the deadbolt toward the extended position.

2. The combination as claimed in claim 1, flitter comprising means for effecting deadlocking of the deadbolt.

3. The combination as claimed in claim 2, flitter comprising a projection extending transversely out from the deadbolt and wherein the deadlocking effecting means is adapted for moving from a blocking position to a clearing position with respect to the projection.

4. The combination as claimed in claim 3, wherein the deadlocking effecting means comprises an urn pivotally secured on the frame, the arm having a blocking surface adapted in the blocking position of the urn to be disposed in the path of the projection for preventing the deadbolt from being depressed from the extended position.

5. The combination as claimed in claim 4, further comprising means for canceling deadlocking of the deadbolt.

6. The combination as in claim 5, wherein the deadlocking canceling means comprises a first actuator means for moving then from the blocking to the clearing position.

7. The combination as claimed in claim 6, wherein the deadlocking canceling means further comprises a second actuator means for moving the arm from the blocking to the clearing position.

8. The combination as claimed in claim 7, wherein the second arm moving actuator means comprises an extension on the press bar assembly for engaging the arm when the prom bar is pushed and moving the arm form the blocking position to the clearing position.

9. The combination as claimed in claim 8, wherein the first arm moving actuator means comprises a deadlocking plunger adjacent the deadbolt, the deadlocking plunger having a cam surface for moving the arm to the clearing position and holding the arm in the clearing position when the deadlocking plunger is extended.

10. In combination:

a pivoting door, the door having a hinged edge and a free edge and a major surface comprising a door face which is the trailing surface of the door as the door pivots in a direction from a closed position to an open position; and an exit device, the exit device comprising a. a frame including a base plate having a longitudinal axis and side plates secured to and extending up on either side of the base plate, the frame mounted on the door face which is the trailing surface of the door, b. a pin secured to and extending between the side plates spaced from the base plate, c. a deadbolt between the pin and the base plate, to deadbolt having a longitudinal axis parallel to the longitudinal axis of the base plate and slidable longitudinally with respect to the base plate from an extended position, where the deadbolt is adapted to be received in a keeper mounted adjacent the free edge of the door when the door is in the closed position, to a retracted position and having a serrated longitudinal surface, d. a retractor blade pivotally mounted on the pin for movement from an extended position to a retracted position, the retractor blade including a periphery having a serrated deadbolt pressure surface extending along the periphery adapted as the retractor blade pivots to engage the serrated deadbolt surface and to roll progressively along the surface on the deadbolt for retracting the deadbolt, and a strike-plate-engaging surface for engaging a strike plate as the door closes for pivoting the refractor blade to the retracted position as the deadbolt pressure surface engages the abutment surface and retracts the deadbolt, e. a manually operated press bar assembly is disposed on the trailing surface of the door and adapted to be mounted on the frame, the press bar operatively connected to the retractor blade so that when the press bar is pushed the retractor blade pivots to the refracted position as the deadbolt pressure surface engages the deadbolt surface and retracts the deadbolt while supporting the deadbolt for minimizing the force necessary to move the deadbolt to the retracted position as the door is pushed open under conditions of high outward force on the door and exit device by countering the inward force on the deadbolt and defeating fiction generated as the deadbolt is pressed outward against the keeper, and f. a spring for urging the deadbolt toward the extended position.

11. The combination as claimed in claim 10, further comprising means for effecting deadlocking of the deadbolt.

12. The combination as claimed in claim 11, further comprising a projection extending transversely out from the deadbolt and wherein the deadlocking effecting means is adapted for moving from a blocking position to a clearing position with respect to the projection.

13. The combination as claimed in claim 12, wherein the deadlocking effecting means comprises an arm pivotally secured on the frame, the inn having a blocking surface adapted in the blocking position of the cm to be disposed in the path of the projection for preventing the deadbolt from being depressed from the extended position.

14. The combination as claimed in claim 13, further comprising means for canceling deadlocking of the deadbolt.

15. The combination as claimed in claim 14, wherein the deadlocking canceling means comprises a first actuator means for moving the arm from the blocking to the clearing position.

16. The combination as claimed in claim 15, wherein the deadlocking canceling means farther comprises a second actuator means for moving the arm from the blocking to the clearing position.

17. The combination as claimed in claim 16, wherein the second arm moving actuator means comprises an extension on the press bar assembly for engaging the arm when the press buy is pushed and moving the arm from the blocking position to the clearing position.

18. The combination as claimed in claim 17, wherein the first arm moving actuator means comprises a deadlocking plunger adjacent the deadbolt, the deadlocking plunger having a cam surface for moving the arm to the clearing position and holding the arm in the clearing position when the deadlocking plunger is extended.

19. In combination:

a pivoting door, the door having a hinged edge and a free edge and a major surface comprising a door face which is the trailing surface of the door as the door pivots in a direction from a closed position to an open position, and an exit device, the exit device comprising a frame having a longitudinal axis and mounted on the door face which is the trailing surface of the door, a deadbolt movably mounted in the frame, the deadbolt adapted to be received in a keeper mounted adjacent the free edge of the door when the door is in the closed position, the deadbolt having a longitudinal axis parallel to the longitudinal axis of the frame, a pressbar assembly disposed on the trailing surface of the door and mounted on the frame and operatively connected to the deadbolt for retracting the deadbolt when the pressbar is pushed, means for supporting the movement of the deadbolt pivotally mounted on the frame, the supporting means having a peripheral surface for engaging and rolling along a longitudinal deadbolt surface as the supporting means pivots for supporting retraction of the deadbolt and minimizing the force necessary to move the deadbolt to the retracted position as the door is pushed open under conditions of high outward force on the door and exit device by countering the inward force on the deadbolt and defeating friction generated as the deadbolt is pressed outward against the keeper, and means far engaging the supporting means and the deadbolt for cooperative movement between the deadbolt and the supporting means.

20. The combination as claimed in claim 19, wherein the supporting means is formed with a keeper-engaging surface for engaging a keeper and pivoting the supporting means to refract the deadbolt as the door is closed.

21. The combination as claimed in claim 19, wherein the engaging means comprises a non-longitudinal surface on the deadbolt and a retracting surface on the supporting means for engaging the non-longitudinal surface of the deadbolt as the deadbolt retracts to pivot the supporting means.

22. The combination as claimed in claim 19, wherein the engaging means comprises interengaging serrated surfaces on the deadbolt and supporting means.

23. The combination as claimed in claim 19, further comprising means for effecting deadlocking of the deadbolt.

24. The combination as claimed in claim 23, further comprising a projection extending transversely out from the deadbolt and wherein the deadlocking effecting means is adapted for moving from a blocking position to a clearing position with respect to the projection.

25. The combination as claimed in claim 24, wherein the deadlocking effecting means comprises an arm pivotally secured on the frame, the arm having a blocking surface adapted in the blocking position of the arm to be disposed in the path of the projection for preventing the deadbolt from being depressed from the extended position.

26. The combination as claimed in claim 24, further comprising means for canceling deadlocking of the deadbolt.

27. The combination an claimed in claim 26, wherein the deadlocking canceling means comprises a first actuator means for moving the deadlocking effecting means from the blocking position to the clearing position.

28. The combination as claimed in claim 27, wherein the deadlocking canceling means further comprises a second actuator means for moving the deadlocking effecting means from the blocking position to the clearing position.

29. The combination as claimed in claim 27, wherein the first actuator means for moving the deadlocking effecting means comprises a deadlocking plunger adjacent the deadbolt, the deadlocking plunger having a cam surface for moving the deadlocking effecting means to the clearing position and holding the deadlocking effecting means in the clearing position when the deadlocking plunger is extended.

30. The combination claimed in claim 28, wherein the second actuator moans for moving the deadlocking effecting means comprises an extension on the press bar assembly for engaging the deadlocking effecting means when the press bar is pushed and moving the deadlocking effecting means from the blocking position to the clearing position.

31. In combination:

a pivoted door, the door having a hinged edge and a free edge and a major surface comprising a door face which is the trailing surface of the door as the door pivots in a direction from a closed position to an open position, and an exit device, the exit device comprising a. means for supporting the exit device mounted on the door face which is the trailing surface of the door, the supporting means having a longitudinal axis, b. means disposed on the trauma surface of the door for actuating the exit device, c. a deadbolt in the supporting means, the deadbolt having a longitudinal axis parallel to the longitudinal axis of the supporting means and longitudinally moveable with respect to the longitudinal axis of the supporting means from an extended position, where the deadbolt is adapted to be received in a keeper mounted adjacent the free edge of the door when the door is in the closed position, to a retracted position, d. means for halting to actuating means and the deadbolt for moving to deadbolt from the extended to the retracted position when the actuating means is actuated, and e. a bearing member pivotally mounted in the supporting means, the bearing member including a bearing surface aligned with a longitudinal deadbolt surface for engaging and rolling along the deadbolt surface as the deadbolt is moved to the retracted position for supporting the longitudinal movement of to deadbolt and minimizing the force necessary to move the deadbolt to the retracted position as the door is pushed open under conditions of high outward force on the door and exit device by countering the inward force on the deadbolt and defeating friction generated as the deadbolt is pressed outward against the keeper, the deadbolt returning to the extended position when the actuating means is released.

32. The combination as claimed in claim 31, wherein the deadbolt has a non-longitudinal surface and the bearing member has a retracting surface for engaging the non-longitudinal surface of to deadbolt as the deadbolt retracts for pivoting the bearing member.

33. The combination as claimed in claim 32, wherein the retracting surface comprises a projecting nose.

34. The combination as claimed in claim 33, wherein the bearing member has a keeper-engaging surface spaced from the projecting nose and wherein the bearing surface is disposed intermediate the projecting nose and the keeper-engaging surface.

35. The combination as claimed in claim 31, wherein the deadbolt and bearing member further comprise interengaging serrated surfaces.

36. The combination as claimed in claim 31, further comprising means for effecting deadlocking of the deadbolt.

37. The combination claimed in claim 36, wherein the deadlocking effecting means is adapted to be moved from a blocking position to a clearing position with respect to the deadbolt, the deadlocking effecting means adapted in the blocking position to be disposed in the path of the deadbolt for preventing the deadbolt from being depressed from the extended position.

38. The combination as claimed in claim 37, wherein the deadlocking effecting means comprises an arm pivotally secured on the frame means, the arm having a blocking surface adapted in the blocking position of the arm to be disposed in the path of the deadbolt for preventing the deadbolt from being depressed from the extended position.

39. The combination as claimed in claim 37, further comprising means for canceling deadlocking of the deadbolt.

40. The combination as claimed in claim 39, wherein the deadlocking canceling means comprises means for moving the deadlocking effecting means from the blocking position to the clearing position.

41. The combination as claimed in claim 40, wherein the means for moving the deadlocking effecting means comprises an extension on the linking means which engages the deadlocking effecting means when the actuating means is actuated for moving the deadlocking effecting means from the blocking to the clearing position.

42. The combination as claimed in claim 40, wherein the means for moving the deadlocking effecting means comprises a deadlocking plunger, the deadlocking plunger having a cam surface which moves the deadlocking effecting means to the clearing position and holds it in the clearing position when the deadlocking plunger is extended.

* * * * *

UNITED STATES PATENT AND TRADEMARK OFFICE

CERTIFICATE OF CORRECTION

PATENT NO. : 6,779,819 B2
DATED : August 24, 2004
INVENTOR(S) : Walter E. Surko, Jr.

It is certified that error appears in the above-identified patent and that said Letters Patent is hereby corrected as shown below:

Column 9,
Line 52, change “aide” to -- side --.

Column 10,
Line 8, change “refracted” to -- retracted --.
Line 11, add -- the -- between “on trailing”.
Line 11, add -- and -- between “door mounted”.
Line 24 and 25, change “flitter” to -- further --.
Lines 32 and 34, change “urn” to -- arm --.
Line 42, change “then” to -- the arm --.
Line 49, change “prom” to -- press --.

Column 11,
Line 3, change “to” to -- the --.
Line 21, change “refractor” to -- retractor --.
Line 30, change “retracted” to -- retracted --.
Line 37, change “fiction” to -- friction --.
Line 50, change “inn” to -- arm --.
Line 51, change “cm” to -- arm --.
Line 62, change “farther” to -- further --.

Column 12,
Line 1, change “buy” to -- bar --.
Line 37, change “far” to -- for --.
Line 43, change “refract” to -- retract --.

Column 13,
Line 1, change “an” to -- as --.
Line 16, add -- as -- between “combination clamed”.
Line 17, change “moans” to -- means --.
Line 29, add -- adapted to be -- between “device mounted”.
Line 32, change “trauma” to -- trailing --.
Line 42, change “halting to” to -- linking the --.
Lines 43 and 51, change “to” to -- the --.

UNITED STATES PATENT AND TRADEMARK OFFICE

CERTIFICATE OF CORRECTION

PATENT NO. : 6,779,819 B2
DATED : August 24, 2004
INVENTOR(S) : Walter E. Surko, Jr.

It is certified that error appears in the above-identified patent and that said Letters Patent is hereby corrected as shown below:

Column 14,
Line 8, change "to" to -- the --.
Line 22, add -- as -- between "combination claimed".

Signed and Sealed this

Fourteenth Day of December, 2004

JON W. DUDAS
*Director of the United States Patent and Trademark Office*